US008904722B2

(12) United States Patent
Smith

(10) Patent No.: US 8,904,722 B2
(45) Date of Patent: Dec. 9, 2014

(54) STRUCTURES WITH INTERLOCKING COMPONENTS

(71) Applicant: Nathan H. Smith, Richmond, UT (US)

(72) Inventor: Nathan H. Smith, Richmond, UT (US)

( * ) Notice: Subject to any disclaimer, the term of this patent is extended or adjusted under 35 U.S.C. 154(b) by 0 days.

(21) Appl. No.: 13/828,563

(22) Filed: Mar. 14, 2013

(65) Prior Publication Data

US 2014/0260014 A1 Sep. 18, 2014

(51) Int. Cl.
*E04C 5/08* (2006.01)
*E04H 12/16* (2006.01)

(52) U.S. Cl.
CPC ..... *E04H 12/16* (2013.01)
USPC ..... 52/223.4; 52/114; 52/118; 52/121; 52/653.1; 52/223.5

(58) Field of Classification Search
CPC ..... E04H 12/16; E04H 12/18; E04H 12/182; E04H 12/34; B66F 3/22; E04B 2001/1975
USPC ..... 52/223.1, 223.4, 223.5, 223.9, 223.14, 52/588.1, 589.1, 651.01, 651.07, 838, 848
See application file for complete search history.

(56) References Cited

U.S. PATENT DOCUMENTS

| | | | | |
|---|---|---|---|---|
| 2,661,082 | A | 12/1953 | Ziegler | |
| 4,386,485 | A | 6/1983 | Kramer | |
| 4,651,480 | A * | 3/1987 | Kramer | 52/108 |
| 4,875,660 | A | 10/1989 | Cagnon et al. | |
| 4,920,710 | A | 5/1990 | Paine | |
| 5,826,384 | A * | 10/1998 | O'Neill | 52/223.9 |
| 5,980,160 | A * | 11/1999 | Vanderklaauw | 405/230 |
| 6,026,626 | A * | 2/2000 | Fisher | 52/633 |
| 6,224,037 | B1 | 5/2001 | Novick | |
| 6,430,891 | B1 * | 8/2002 | Adams | 52/848 |
| 7,357,365 | B2 | 4/2008 | Colman et al. | |
| 8,042,305 | B2 | 10/2011 | Pryor et al. | |
| 8,069,954 | B2 | 12/2011 | Kempf | |
| 8,303,143 | B2 | 11/2012 | Webb | |
| 2004/0052589 | A1 * | 3/2004 | Lewis | 405/284 |
| 2004/0220004 | A1 * | 11/2004 | Bourc'His | 474/152 |
| 2012/0102850 | A1 | 5/2012 | Kensinger et al. | |

* cited by examiner

*Primary Examiner* — William Gilbert
*Assistant Examiner* — Patrick Maestri
(74) *Attorney, Agent, or Firm* — Jerry Haynes Law

(57) ABSTRACT

Structures with interlocking components include a plurality of interlocking structure sections, each of the interlocking structure sections including at least one tensioning component and a plurality of compression components carried by the at least one tensioning component. The at least one tensioning component secures alternating ones of the plurality of compression components in adjacent ones of the plurality of interlocking structure sections in end-to-end, interlocking compression with each other.

10 Claims, 12 Drawing Sheets

STRUCTURES WITH INTERLOCKING COMPONENTS

FIELD OF THE INVENTION

Illustrative embodiments of the disclosure generally relate to structures used for various purposes. More particularly, illustrative embodiments of the disclosure generally relate to structures which can be expeditiously deployed using interlocking tension and compression components and exhibit properties normally associated with a rigid structure.

BACKGROUND OF THE INVENTION

Various structures such as antenna towers, light towers, wind towers, drilling rigs, lifting actuators and the like are typically constructed of rigid materials to ensure the strength and integrity of the structure throughout its use. These structures may require large and heavy equipment such as cranes to erect. Moreover, erection of the structures may be laborious and time-consuming and may require hundreds or thousands of different parts. These considerations render the construction of many types of structures unsatisfactory and time- and cost-prohibitive for their intended purposes.

Accordingly, structures which can be expeditiously deployed using interlocking tension and compression components and which exhibit properties normally associated with a rigid structure may be desirable for some applications.

SUMMARY OF THE INVENTION

Illustrative embodiments are generally directed to structures with interlocking components which can be expeditiously deployed using interlocking tension and compression components and which exhibit properties normally associated with a rigid structure. An illustrative embodiment of the structure includes a plurality of interlocking structure sections, each of the interlocking structure sections including at least one tensioning component and a plurality of compression components carried by the at least one tensioning component. The at least one tensioning component secures alternating ones of the plurality of compression components in adjacent ones of the plurality of interlocking structure sections in end-to-end, interlocking compression with each other.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "lateral" and "medial" as used herein are intended for descriptive purposes only and are not necessarily intended to be construed in a limiting sense.

Figure 1:
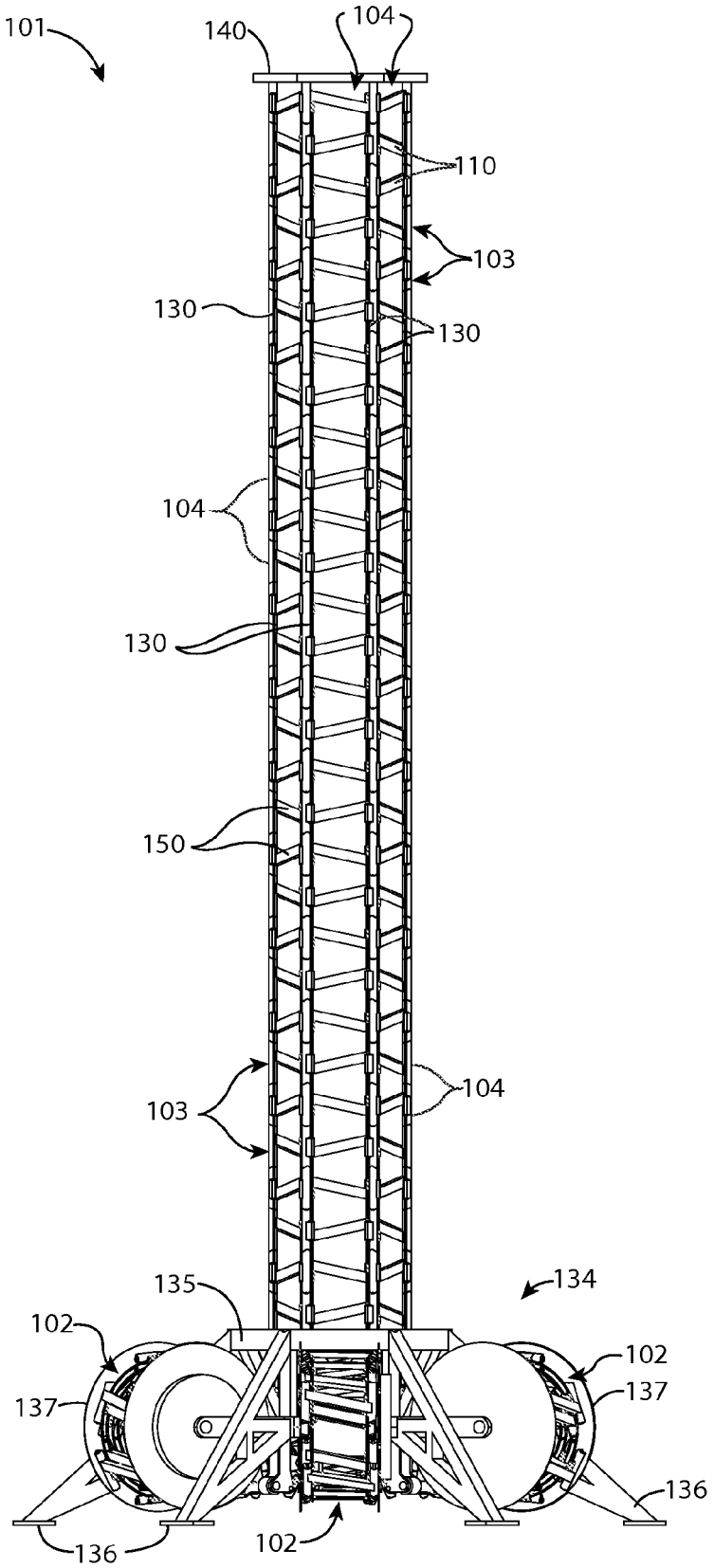
FIG. 1 is a front view of an illustrative embodiment of a tower structure with interlocking components, more particularly illustrating an exemplary structure deployment technique.
Figure 2:
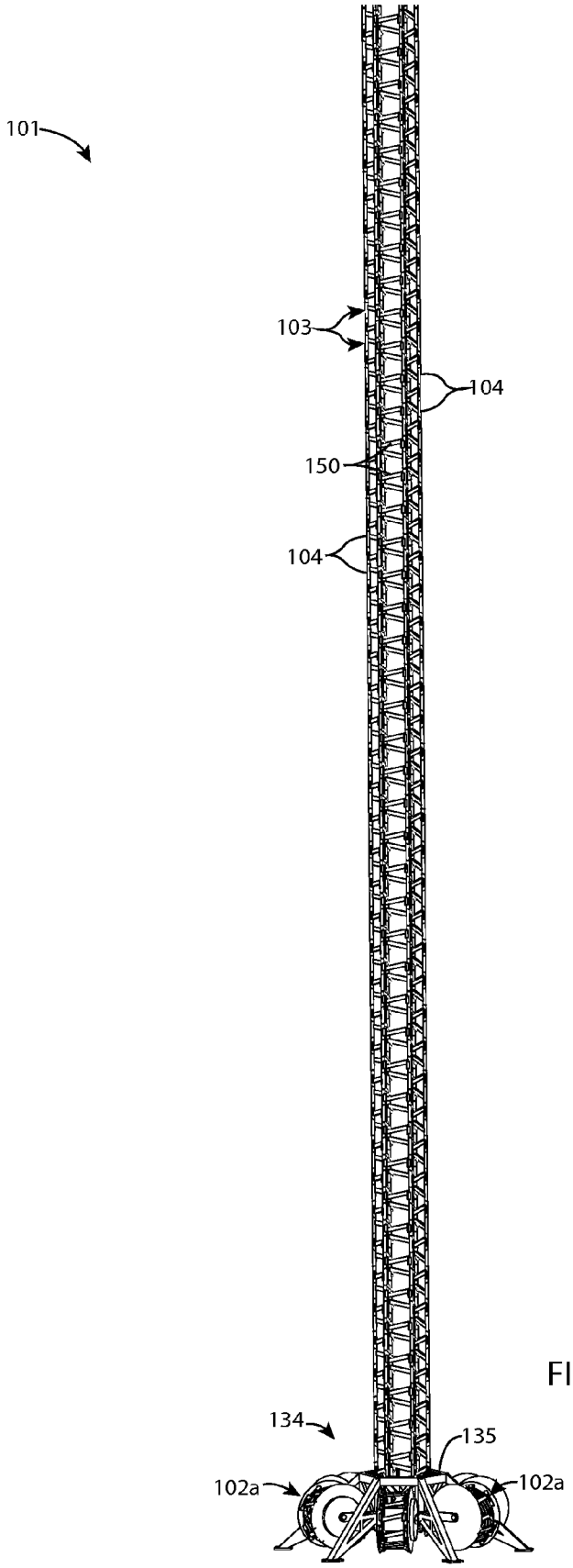
FIG. 2 is a front view of the growing tower structure illustrated in FIG. 1.

Referring initially to FIGS. 1-6 of the drawings, an illustrative embodiment of a tower-shaped structure with interlocking components, hereinafter structure, is generally indicated by reference numeral 101. As illustrated in FIGS. 1 and 2, in some embodiments, the structure 101 may be deployed as a tower. It will be recognized and understood by consideration of the following description, however, that the structure 101 may be deployed as a column, a dish, a parabola, a dome, a wall or other exoskeletal shape.

The tower-shaped structure 101 may have multiple interlocking structure sections 104, each corresponding to a side of the structure 101. The interlocking structure sections 104 may together form a, rectangle, hexagon or other shape. Each interlocking structure section 104 of the structure 101 may include a series of compression components 103 each of which interlocks, above and below, with a compression component 103 in an adjacent interlocking structure section 104. The compression elements 103 of each interlocking structure section 104 may therefore alternate with the compression elements 103 of each adjacent interlocking structure section 104 around the structure 101.

The interlocking structure sections 104 of the structure 101 may be formed from multiple compression component chains 102. Each compression component chain 102 includes multiple compression components 103. At least one tensioning component 130 securely but flexibly connects the compression components 103 to each other in each compression component chain 102. The tensioning components 130 additionally secure the compression components 103 in each compression component chain 102 and the alternating compression components 103 in the adjacent compression component chains 102 into end-to-end, interlocking compression with each other to form the respective interlocking structure sections 104 of the structure 101.

Figure 3:
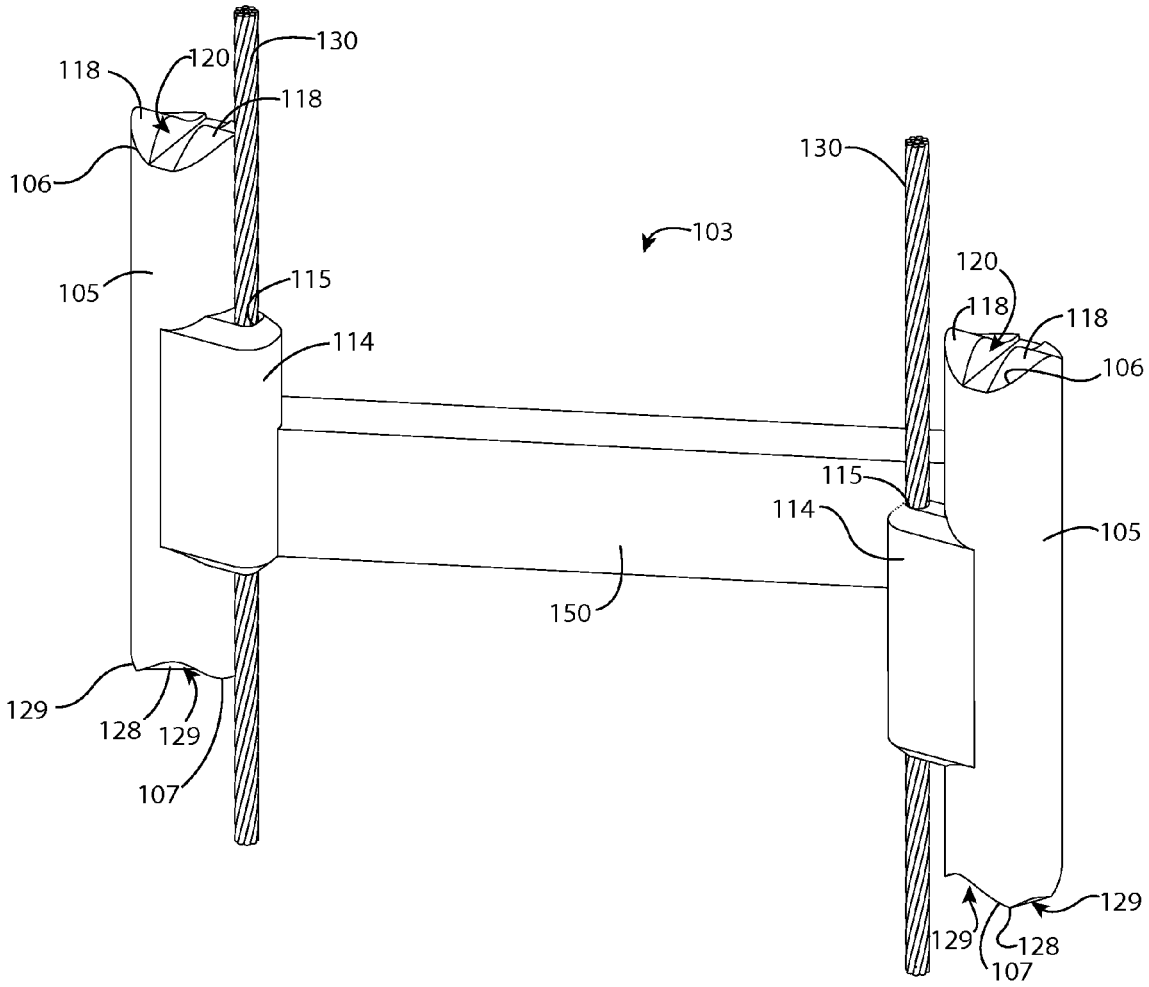
FIG. 3 is a perspective view of an exemplary compression component of the illustrative tower structure with interlocking components.

As illustrated in FIG. 3, each compression component 103 may be generally H-shaped with a pair of generally elongated, parallel, spaced-apart compression component shafts 105. Each compression component shaft 105 may have a female end 106 and a male end 107. At least one shaft connecting member 150 connects the compression component shafts 105 to each other. In some embodiments, the long axis of the shaft connecting member 150 may be oriented in generally angled relationship with respect to the long axis of each compression component shaft 105. In some embodiments, each compression component shaft 105 may have a round or circular cross-section, as illustrated. In other embodiments, each compression component shaft 105 may have a triangular, square, rectangular or other polyhedral cross-section. A male flange 128 may extend from the male end 107 of the compression component shaft 105. A pair of female flange spaces 129 may be provided on opposite sides of the male flange 128. A pair of female flanges 118 may extend from the female end 106 of the compression component shaft 105 in spaced-apart relationship to each other. A male flange space 120 is formed by and between the female flanges 118.

A tensioning component body 114 may extend from each compression component shaft 105 of each compression component 103. A tensioning component opening 115 may extend through the tensioning component body 114. The tensioning component opening 115 is adapted to accommodate the tensioning component 130 (illustrated in phantom in FIG. 3), as will be hereinafter further described.

Figure 4:
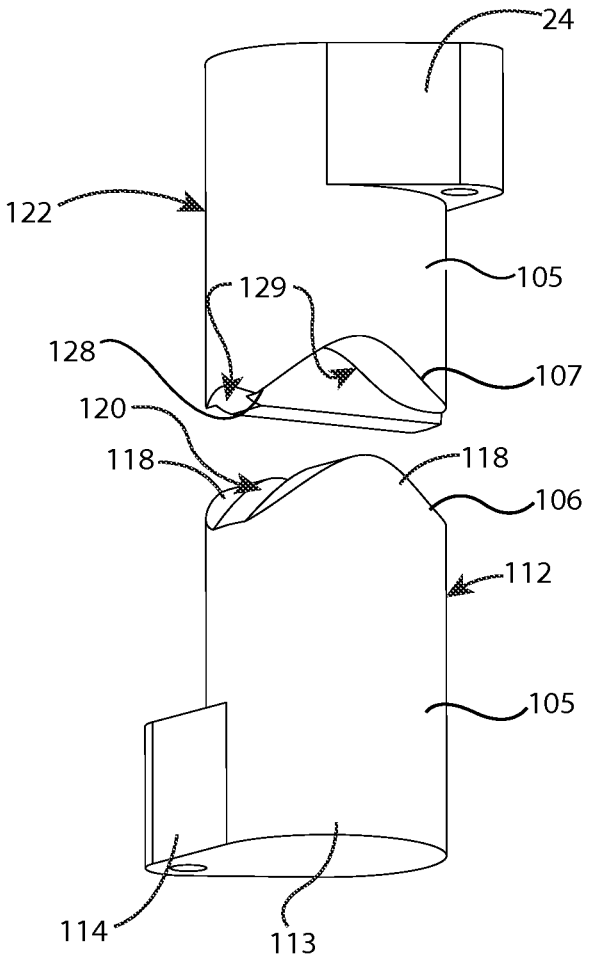
FIG. 4 is an exploded perspective view of a female fitting on a first compression component (partially in section) and interfacing with a companion male fitting on a second compression component (partially in section)
Figure 5:
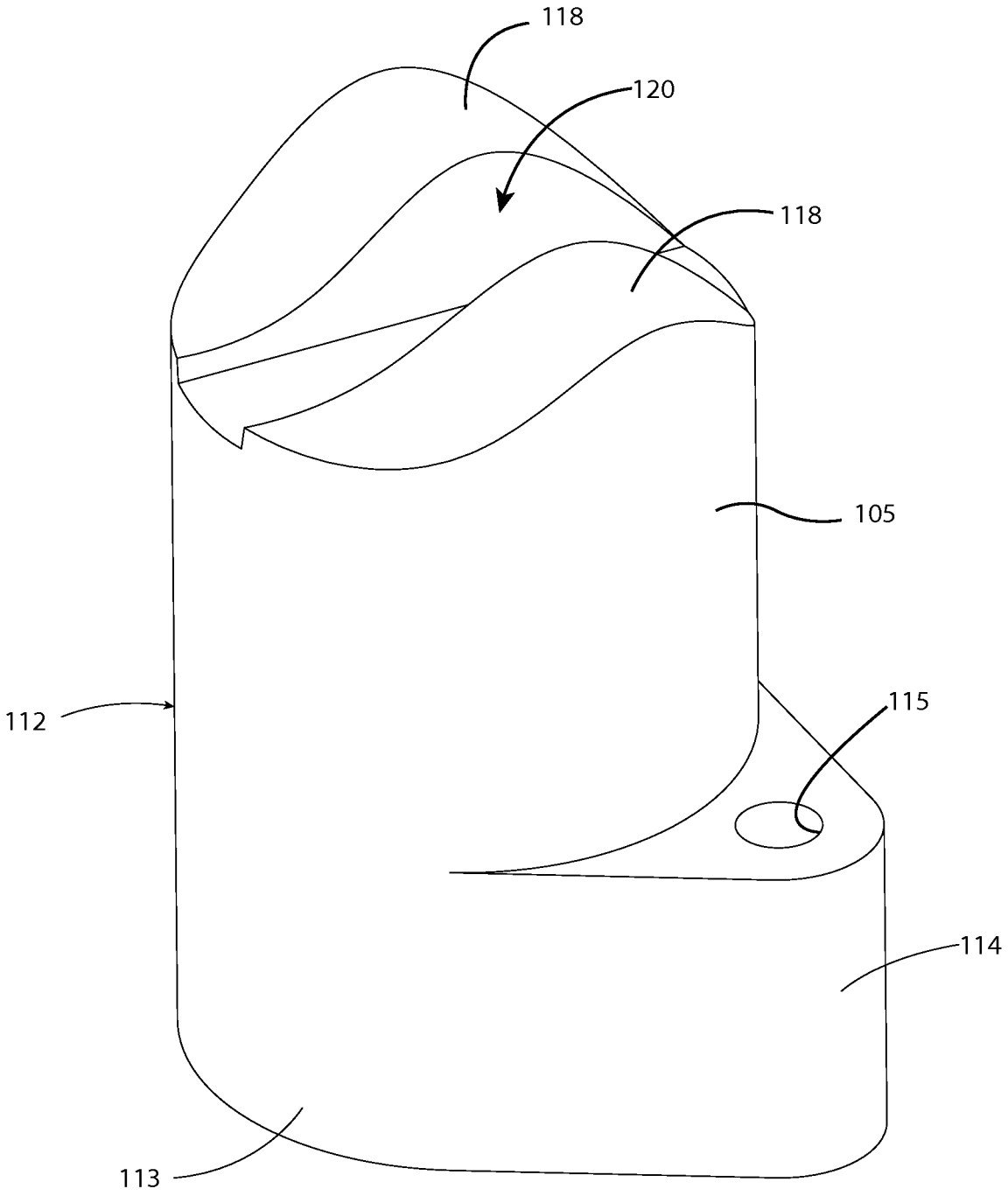
FIG. 5 is a perspective view of an exemplary female fitting on a compression component

As illustrated in FIG. 4 and will be hereinafter further described, each compression component 103 of each compression component chain 102 (FIG. 1) may be interlocked or "zipped" in compression, above and below, with the compression components 103 in the adjacent compression component chains 102, respectively, to form the interlocking structure sections 104 around the structure 101. This may be accomplished as the male flange 128 on each compression component 103 in each compression component chain 102 inserts into the male flange space 120 on a compression component 103 in one of the adjacent compression component chains 102. The female flanges 118 of each compression component 103 in each compression component chain 102 insert into the respective female flange spaces 129 in a compression component 103 in one of the adjacent compression component chains 102.

Each compression component 103 may be fabricated of any substantially rigid material which is consistent with the structural and functional requirements of the structure 1. Examples of materials which are suitable for the purpose include but are not limited to steel, aluminum, composites, plastic, wood, ceramic, concrete or any combination thereof.

Each tensioning component 130 may be any structure, material or component which is suitable for the purpose of connecting the adjacent compression components 103 to each other in each compression component chain 102 and loading the compression components 103 of each compression component chain 102 in compression with the alternating compression components 103 in the respective adjacent compression component chains 102. Examples of structures, materials or components which are suitable for the purpose include but are not limited to wire rope, rope, cable, chain, webbing, metal, spring metal, fabric, hinged tension members or any combination thereof.

Referring again to FIGS. 1 and 2 of the drawings, in exemplary application, the structure 101 may be deployed as follows. Each compression component chain 102 includes multiple compression components 103 which may be securely but flexibly connected to each other along one or more of the tensioning components 130. Each tensioning component 130 may extend through the tensioning component opening 115 in the tensioning component flange 114 on each compression component shaft 105. A retaining mechanism (not illustrated) such as a retainer cap, for example and without limitation, may be placed on each end of each tensioning component 130 to secure the compression components 130 on the tensioning components 130. The tension components 130 can be crimped within the component body 114 by compressing the body to permanently secure the tensioning component within the component opening 115. Because the compression components 103 are spaced out relative to each other over the lengths of the tensioning components 130, each compression component chain 102 can be wound on a chain spool 137 as will be hereinafter described.

A structure assembly unit 134 may include a spool frame 135. Multiple pairs of spaced-apart, adjacent spool frame legs 136 may extend from the spool frame 135. A chain spool 137 may be rotatably mounted between each pair of spool frame legs 136. The chain spools 137 may be arranged around the spool frame 135 in the form of a, a rectangle, a hexagon or other shape depending on the desired number and configuration of the interlocking structure sections 104 in the structure 101.

As the tower is deployed by a force including but not limited to a motor 160, or hand crank (not illustrated), a spool motor (not illustrated) may drivingly engage each chain spool 137 to rotate the chain spool 137 between the corresponding pair of spool frame legs 136 Alternatively the chain spool 137 may provide tension on the compression component chain by means of a spring to keep the compression component chain wound on the spool (not illustrated) Accordingly, each compression component chain 102 may be wound on a corresponding chain spool 137. The spool motors and/or springs can be operated in concert to rotate the chain spools 137 and wind the compression component chains 102 on to the respective chain spools 137. As each compression component chain 102 emerges from the corresponding chain spool 137, the compression components 103 in the compression component chain 102 interlock above and below with compression components 103 in the adjacent compression component chains 102, respectively, such that each compression component chain 102 forms each corresponding interlocking structure section 104 of the structure 101. The tensioning components 130 in each compression component chain 102 maintain the interlocking compression components 103 in compression, imparting rigidity to the nascent structure 101 as the structure 101 extends upwardly through the spool frame 135 of the structure assembly unit 134. The interlocking design imparts torsional strength and stability to the deployed structure 101 and prevents the compression components 103 from twisting or pivoting relative to each other in the structure 101.

Figure 2A:
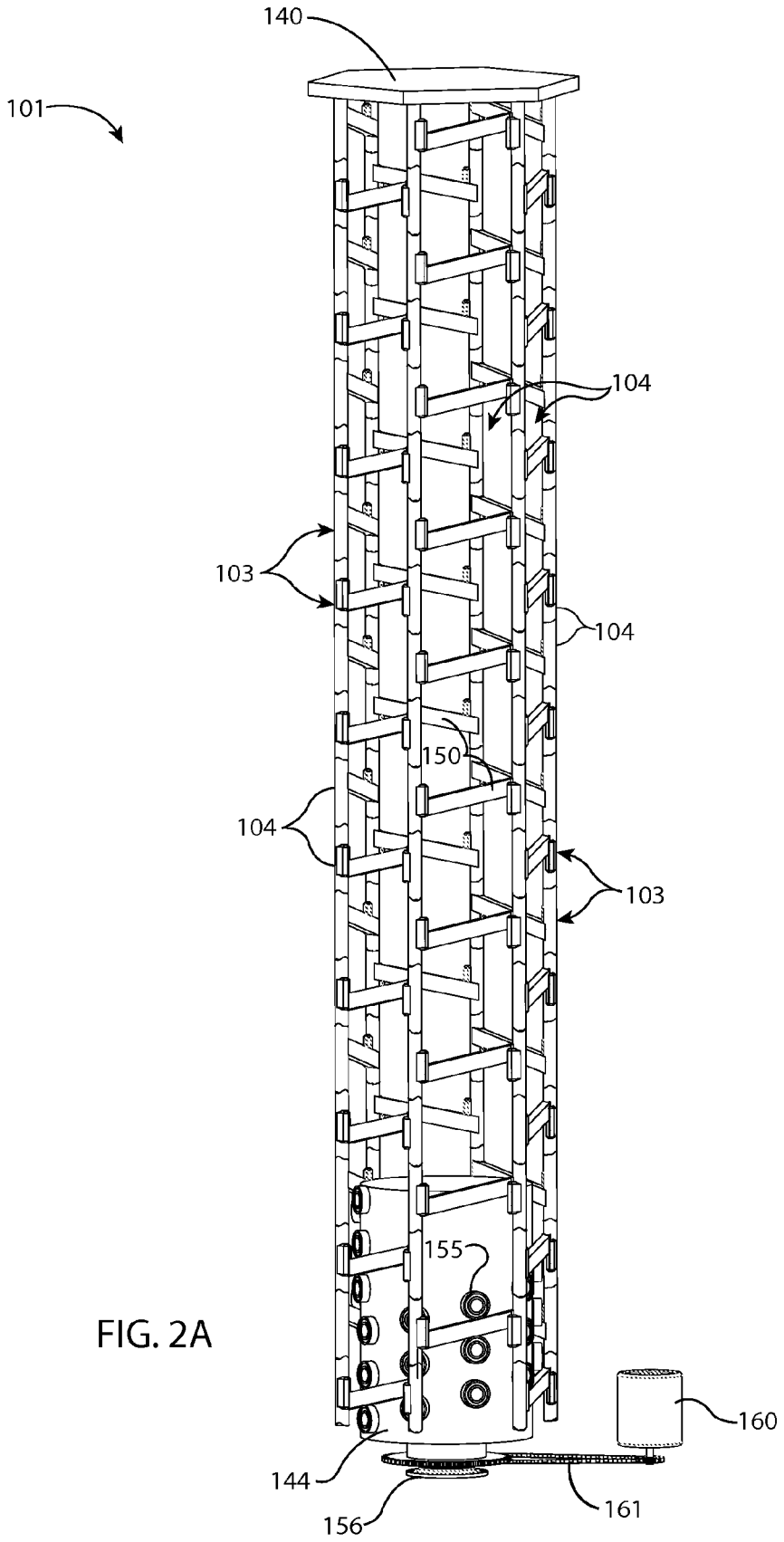
FIG. 2A is a perspective view of a center lifting mechanism for an illustrative tower structure, illustrated partially in section.
Figure 6:
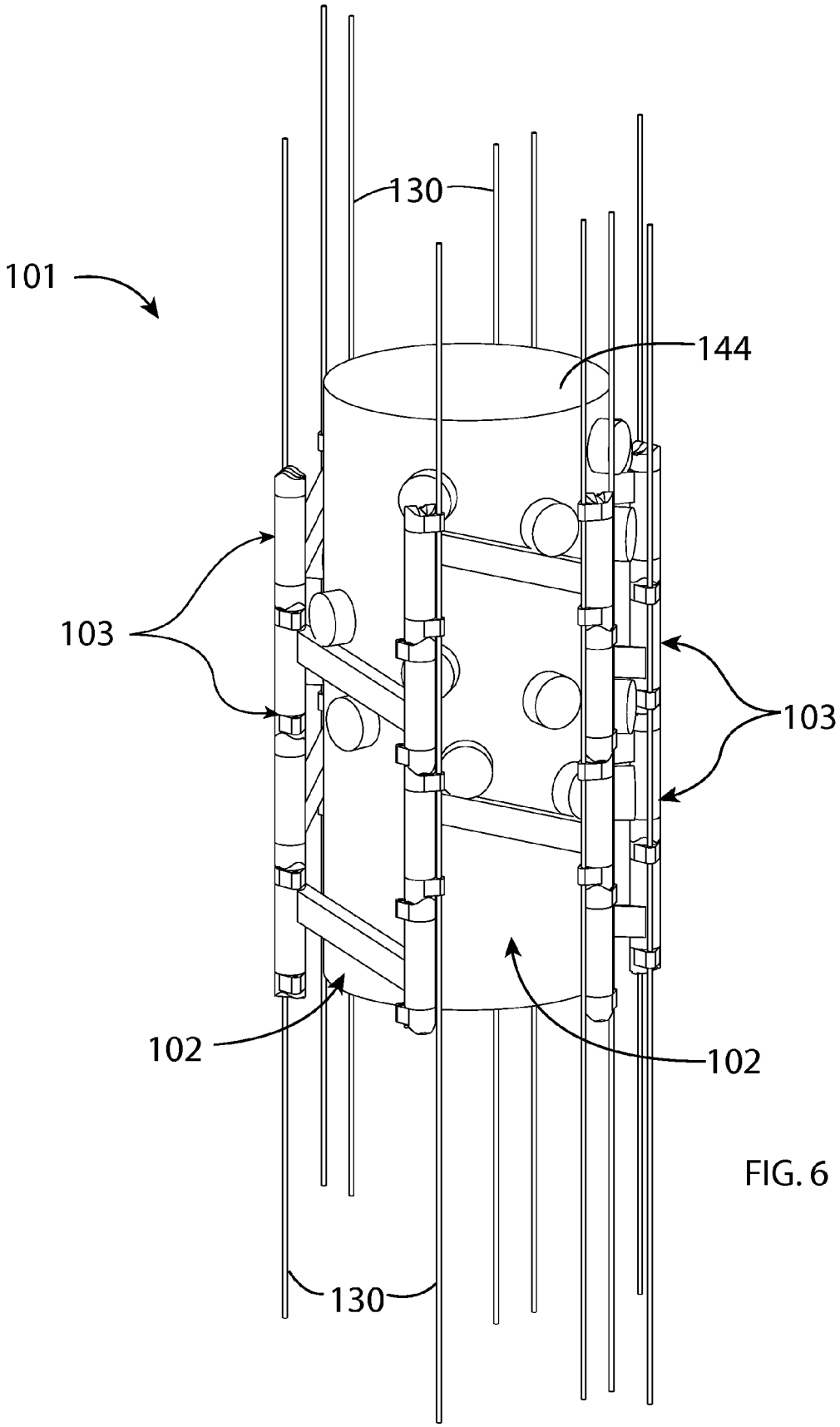
FIG. 6 is a perspective view, partially in section, of a portion of an illustrative embodiment of a structure with interlocking components deployed using multiple compression components and multiple tensioning components.

As illustrated in FIGS. 2A and 6, in some applications, a center lifting mechanism 144 may be provided at the center of the spool frame 135. The center lifting mechanism 144 may impart lifting force when rotated by a motor 160 that rotates a chain 161 and sprocket assembly or other means of rotation additionally, the center lifting mechanism 144 can provide structural stability to the structure 101 as the adjacent compression component chains 102 are interlocked or zipped together to form the respective interlocking structure sections 104 a thrust bearing or other bearing mechanism 156 may be employed to withstand the force of the center lifting mechanism 144 as it is being deployed. In an alternate application, The thrust bearing mechanism or other bearing mechanism 156 can also be employed to withstand the force exerted on the center lifting mechanism 144 as the structure 101 is retracted. This allows both a push and a pull action to the deployment/retraction of the structure 101. As illustrated in FIG. 1, in some applications, a structure cap 140 may be provided on the upper ends of the compression component chains 102 to impart additional structural stability to the interlocking structure sections 104 in the structure 101.

It will be appreciated by those skilled in the art that the height of the structure 101 can be selected, as illustrated in FIG. 2, by selecting the number of compression components 103 which are unwound from each compression component chain 102 and zipped or interlocked with the compression components 103 of the adjacent compression component chains 102. After the structure 101 has assumed the selected height, rotation of the structure base 144 may be terminated by terminating operation of the lifting motor(s) or hand cranks. The erected structure 101 may have any of a variety of uses such as an antenna tower, cell phone tower, light tower, commercial tourist tower, wind tower, a van mast for TV news vans, a telephone pole or lifting apparatus, for example and without limitation. In some applications, multiple structures 101 may be deployed in a selected spatial relationship and proximity to each other to deploy a structure of selected size and height for a desired purpose. The structure 101 can be selectively disassembled by reversing the direction of rotation of the lifting motor 160 or hand crank (not illustrated) such that the compression components 103 in each interlocking structure section 104 are unzipped from the compression components 103 in the adjacent interlocking structure sections 104 and the compression component chains 102 are again wound on the respective chain spools 137.

It will be further appreciated by those skilled in the art that the compression components 103 can be fabricated in any of various shapes to impart various shapes of the structure 101. For example and without limitation, in some embodiments, the compression components 103 can be fabricated in a non-linear or non-planar shape to facilitate deployment of a cylindrical, dome-shaped or wavy structure. The tensioning components 130 can be attached to the compression components 103 in each compression component chain 102 or may simply extend through the tensioning component openings 115 in the tensioning component flanges 114. In some embodiments, wire rope joints can be used as crimp-type joints to connect a wire rope compression component 103 securely to the compression components 103. In other embodiments, the tensioning components 130 may remain unattached to the compression components 103.

In some embodiments, electrical cables (not illustrated) can be routed among the compression components 103 in each compression component chain 102. The electrical cables may include rotating electrical contacts known by those skilled in the art such that the electrical cables can be reeled up in the wound chain portions 102*a* of the compression component chains 102.

In some applications, the sides of the structure 101 can be partially or completely covered by a flexible sheet (not illustrated) of material such as metal fabric, for example and without limitation. The sheet may be structural and may act as a tensioning component 130 and provide sheer strength to the structure. This feature may be particularly advantageous on 4-sided structures 101 having thinner compression components 103. In some embodiments, the tensioning components 130 may be fabricated as folding segments which allow each tensioning component 130 to compress in an accordion configuration and occupy less space when the structure 101 is retracted or stored. In some embodiments the tensioning components may retract into a channel or track (not illustrated) and not onto a spool. This may allow for a lower overall profile of the retracted structure. In some embodiments, the compression components 103 or tensioning components 130 may be fabricated with gear teeth (not illustrated) which may be drivingly engaged by a motor (not illustrated) to facilitate or assist in motorized extension or deployment of the structure 101.

In the various embodiments, the compression component shafts 105 and the shaft connecting member 150 of each compression component 103 can be made of various thicknesses and lengths according to the particular application of the structure 101. The compression components 103 can be tailored to reflect the load and deployment speed requirements of the structure 101.

Figure 7:
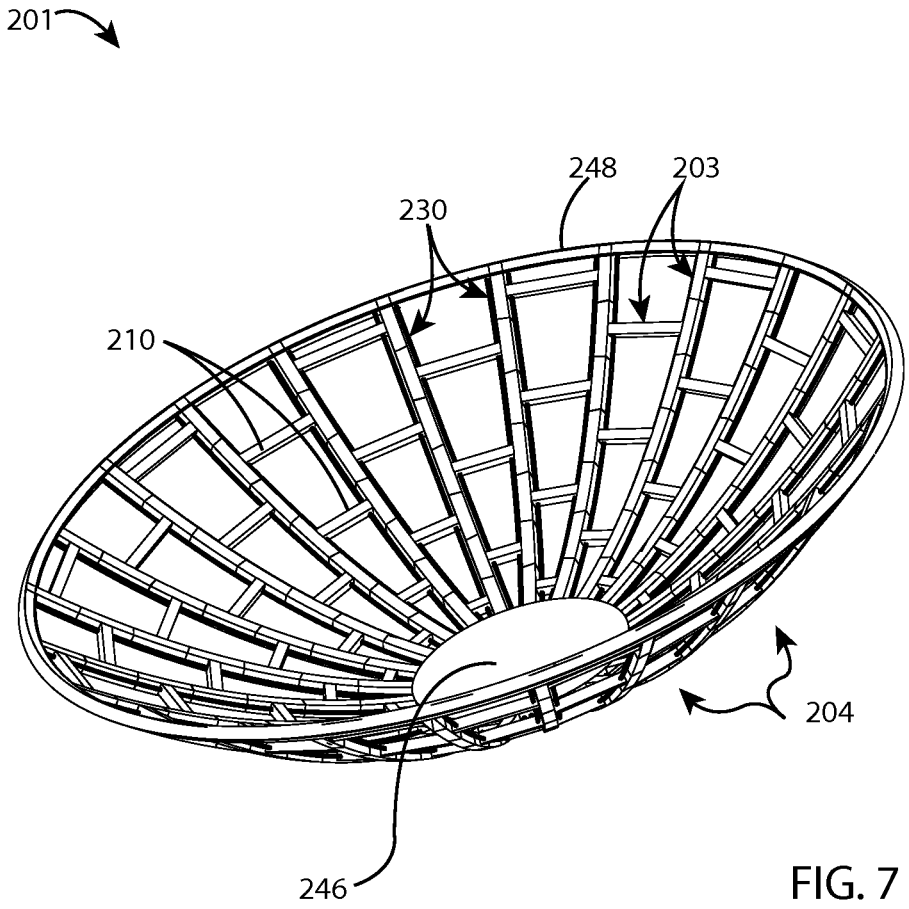
FIG. 7 is a perspective view of an exemplary dish structure with interlocking components, assembled using multiple compression components and multiple tensioning components.
Figure 8:
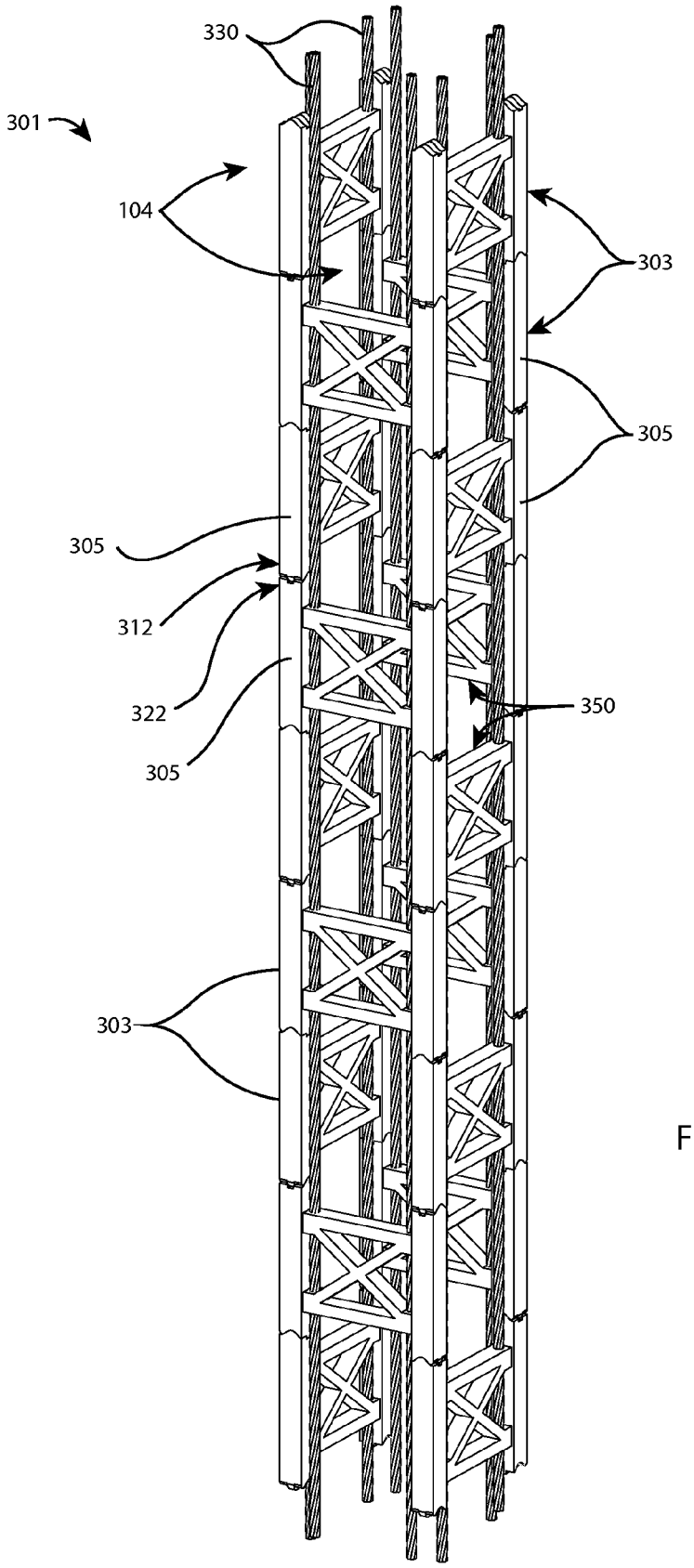
FIG. 8 is a perspective view, partially in section, of an alternative illustrative embodiment of a tower structure with interlocking components.
Figure 9:
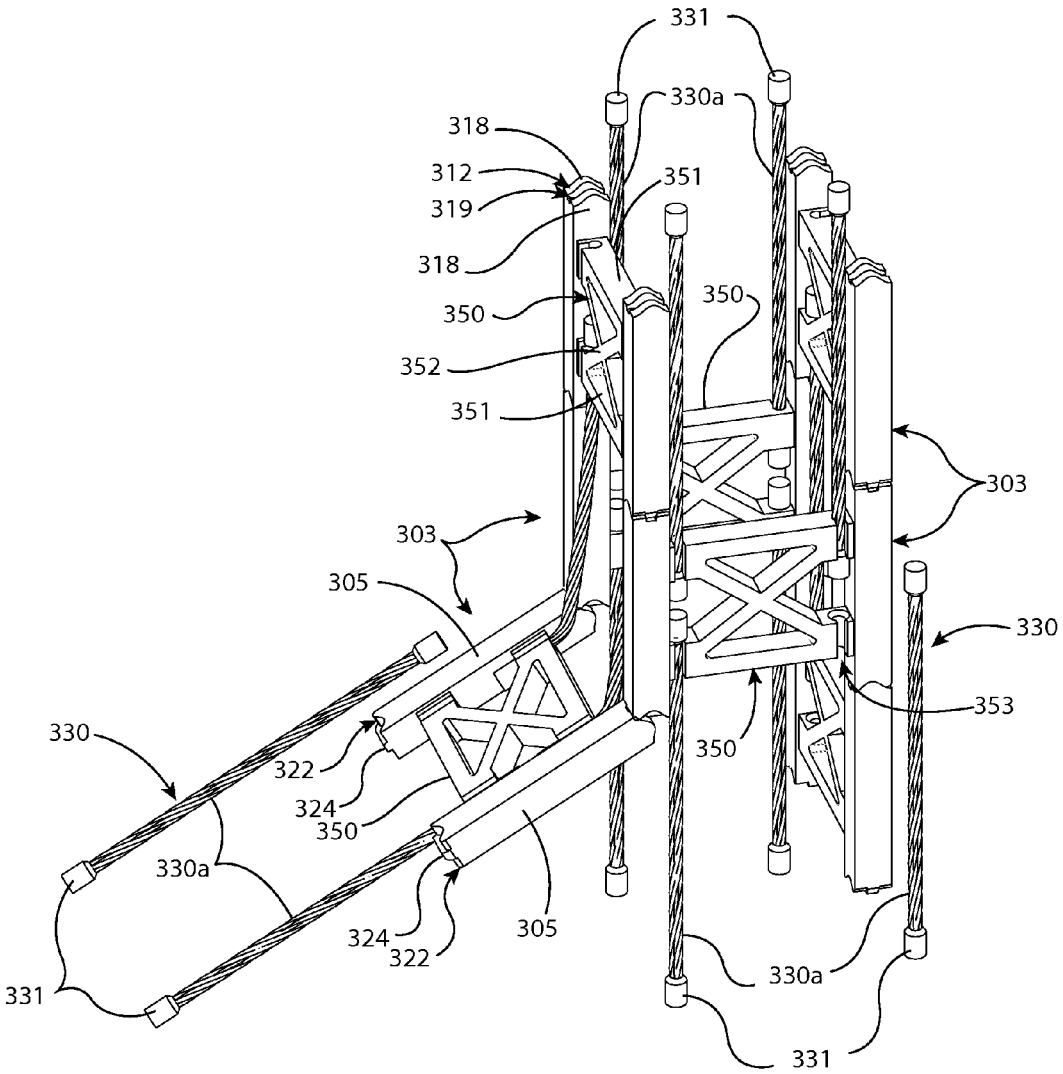
FIG. 9 is an exploded perspective view of a portion of the tower structure with interlocking components illustrated in FIG. 8.
Figure 10:
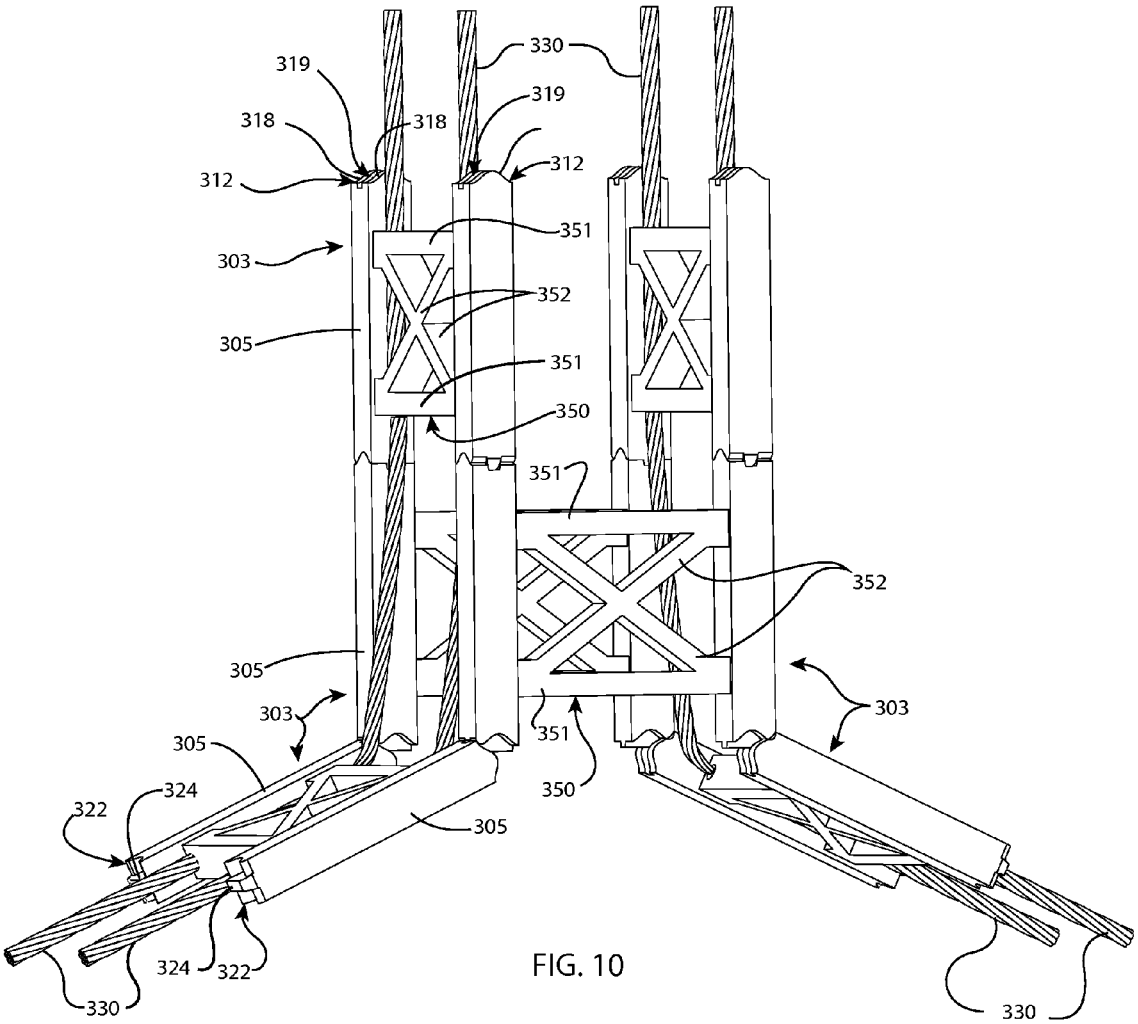
FIG. 10 is a perspective view of a portion of the tower structure with interlocking components illustrated in FIG. 8, more particularly illustrating incorporation of a pair of compression components into the tower structure in deployment of the structure.
Figure 11:
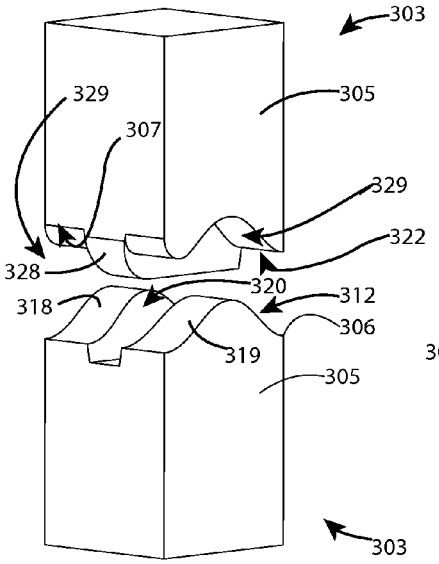
FIG. 11 is a perspective view, partially in section, of a female fitting on a first compression component (partially in section) and interfacing with a companion male fitting on a second compression component (partially in section) according to the illustrative tower structure illustrated in FIG. 8.
Figure 12:
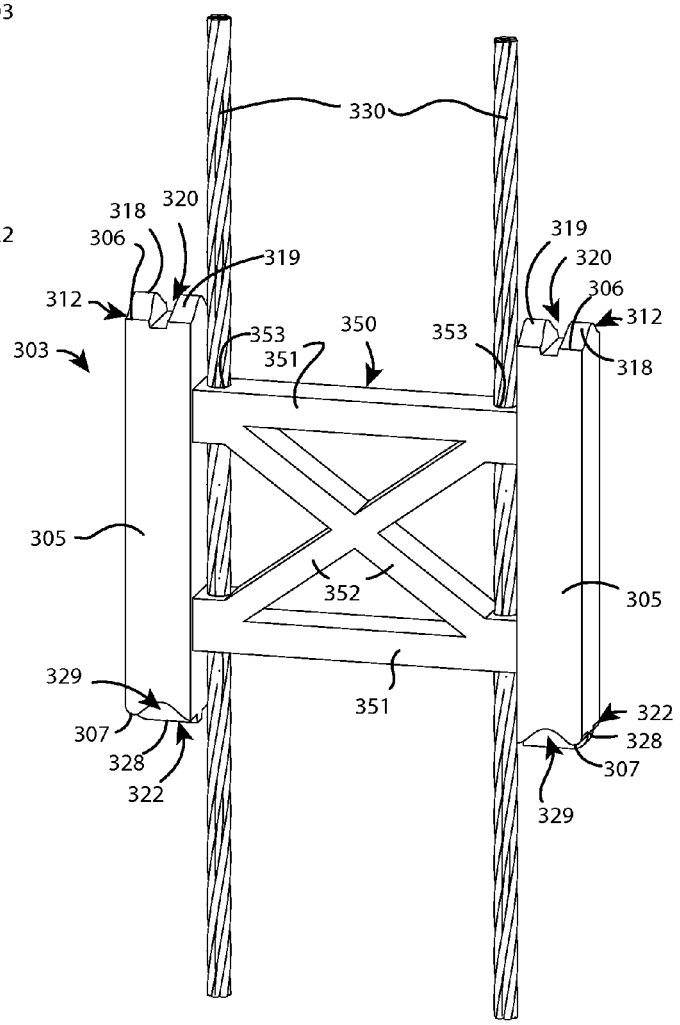
FIG. 12 is a perspective view of a compression component of the illustrative tower structure illustrated in FIG. 8, with a pair of tensioning components interfacing with the compression component.

Referring next to FIG. 7 of the drawings, an alternative illustrative embodiment of the structure with interlocking components 201 is deployed in the form of a dish. In the structure 201 of FIG. 7, elements which are analogous to the respective elements of the structure 101 that was heretofore described with respect to FIGS. 1-6 are designated by the same numeral in the 201-299 series. The dish structure 201 may include a generally disc-shaped structure base 246 and an annular structure rim 248. The compression components 203 of adjacent interlocking structure sections 204 interlock with each other from the structure base 246 to the structure rim 248 to form a concave exoskeleton disk structure. The dish structure 201 may be used as a skeleton or support structure for a satellite dish or other structure in which the dish shape of the structure is inherent or contributory to the function of the structure.

Referring next to FIGS. 8-12 of the drawings, an alternative illustrative embodiment of the structure with interlocking components is generally indicated by reference numeral 301. In the structure 301 of FIG. 7, elements which are analogous to the respective elements of the structure 101 that was heretofore described with respect to FIGS. 1-6 are designated by the same numeral in the 301-399 series. Each compression component 303 of the structure 301 may include a pair of generally elongated, parallel, spaced-apart compression component shafts 305. Each compression component shaft 305 may have a generally square-shaped cross-section, as illustrated, or may have alternative cross-sectional shapes. A lateral female flange 318, a medial female flange 319 and a male flange space 320, and a male flange 328 and a pair of female flange spaces 329, may be provided in a female end 306 and a male end 307, respectively, of each compression component shaft 305.

A shaft connecting member 350 may include a pair of parallel, spaced-apart transverse connector members 351 which extend between the compression component shafts 305. A pair of intersecting connector braces 352 may extend between the transverse connector members 351. Two pairs of aligned or registering tensioning component slots 353 may extend through the transverse connector members 351. Each tensioning component 330 may include multiple tensioning component segments 330*a*, a pair of which attaches adjacent interlocking compression components 303 to each other in the structure 301. Accordingly, a first tensioning component segment 330*a* may be inserted into a first one of each pair of registering tensioning component openings 353 in the shaft connecting member 350 of each compression component 303. A second tensioning component 330*a* may be inserted into a second one of the pair of registering tensioning component openings 353 in the shaft connecting member 350 of each interlocking compression component 303. Retainer caps 331 (FIG. 9) may terminate the respective ends of each tensioning component segment 330*a* to prevent the tensioning component segment 330*a* from slipping through the tensioning component slot 353. Deployment and application of the structure 301 may be as was heretofore described with respect to the structure 101 in FIGS. 1-6.

While illustrative embodiments of the disclosure have been described above, it will be recognized and understood that various modifications can be made and the appended claims are intended to cover all such modifications which may fall within the spirit and scope of the disclosure.

What is claimed is:

1. A structure, comprising:

a plurality of structure sections, each of the structure sections including:

at least one tensioning component; and a series of compression components attached to the at least one tensioning component, each of the series of compression components including:

a pair of compression component shafts;

a pair of spaced-apart female end shaft flanges and a male flange space between the female end shaft flanges on a female end of each of the pair of compression component shafts;

a male end shaft flange and a pair of female flange spaces on opposite sides of the male end shaft flange on a male end of each of the pair of compression component shafts; and a shaft connecting member joining the pair of compression component shafts between the male end and the female end; and wherein the compression components in each of the structure sections alternate and interlock with the compression components in an adjacent one of the structure sections, with the male end on each of the pair of compression component shafts on each of the compression components in each of the structure sections non-rotatably engaging the female end on each of the compression components in the adjacent one of the structure sections.

2. The structure of claim 1 wherein the shaft connecting member is oriented in generally perpendicular relationship with respect to a long axis of each of the pair of compression component shafts.

3. The structure of claim 1 further comprising at least one tensioning component flange extending from each of the plurality of compression components, and wherein the at least one tensioning component extends through the at least one tensioning component flange.

4. The structure of claim 3 further comprising a tensioning component opening extending through the at least one tensioning component body, and wherein the at least one tensioning component extends through the at least one tensioning component opening.

5. The structure of claim 1 wherein each of the plurality of tensioning components is a wire rope, rope, cable, chain, webbing, metal, spring metal, fabric, hinged tension members or any material capable of tension properties or any combination thereof.

6. A structure, comprising:

a plurality of compression component chains each including:

at least one tensioning component;

a series of compression components attached to the at least one tensioning component, each of the series of compression components including a pair of compression component shafts;

a pair of spaced-apart female end shaft flanges and a male flange space between the female end shaft flanges on a female end of each of the pair of compression component shafts;

a male end shaft flange and a pair of female flange spaces on opposite sides of the male end shaft flange on a male end of each of the pair of compression component shafts; and a shaft connecting member joining the pair of compression component shafts between the male end and the female end; and a plurality of interlocking structure sections formed by the plurality of compression component chains as the at least one tensioning component compresses the series of compression components in each of the compression component chains in alternating and interlocking relationship with the series of compression components in an adjacent one of the compression component chains, with the male end on each of the pair of compression component shafts on each of the compression components in each of the structure sections non-rotatably engaging the female end on each of the compression components in the adjacent one of the structure sections.

7. The structure of claim 6 wherein the shaft connecting member is oriented in generally perpendicular relationship with respect to a long axis of each of the pair of compression component shafts.

8. The structure of claim 6 further comprising at least one tensioning component flange extending from each of the plurality of compression components, and wherein the at least one tensioning component extends through the at least one tensioning component flange.

9. The structure of claim 8 further comprising a tensioning component opening extending through the at least one tensioning component flange, and wherein the at least one tensioning component extends through the at least one tensioning component flange.

10. The structure of claim 6 wherein the at least one tensioning component is a wire rope, rope, cable, chain, webbing, metal, spring metal, fabric, hinged tension members or any material capable of tension properties or any combination thereof.

* * * * *